US010966537B1

(12) United States Patent
Denney

(10) Patent No.: US 10,966,537 B1
(45) Date of Patent: Apr. 6, 2021

(54) HYBRID BED FOUNDATION ASSEMBLY

(71) Applicant: Jon K. Denney, Grand Rapids, MN (US)

(72) Inventor: Jon K. Denney, Grand Rapids, MN (US)

( * ) Notice: Subject to any disclaimer, the term of this patent is extended or adjusted under 35 U.S.C. 154(b) by 47 days.

(21) Appl. No.: 15/919,755

(22) Filed: Mar. 13, 2018

Related U.S. Application Data

(60) Provisional application No. 62/492,078, filed on Apr. 28, 2017.

(51) Int. Cl.
*A47C 19/02* (2006.01)
*A47C 19/00* (2006.01)

(52) U.S. Cl.
CPC ..... *A47C 19/025* (2013.01); *A47C 19/005* (2013.01)

(58) Field of Classification Search
CPC ..... A47C 19/00; A47C 19/021
See application file for complete search history.

(56) References Cited

U.S. PATENT DOCUMENTS

| | | | | |
|---|---|---|---|---|
| 6,832,397 | B2 | 12/2004 | Gaboury et al. | |
| 7,003,822 | B1 * | 2/2006 | Sheehy | A47C 19/005 5/200.1 |
| 7,406,727 | B2 | 8/2008 | Wickstrom et al. | |
| 7,703,155 | B1 * | 4/2010 | Roberts | A47C 19/005 403/231 |
| 8,167,012 | B2 | 5/2012 | Hicks et al. | |
| 8,584,277 | B1 | 11/2013 | Roberts | |
| 9,139,332 | B1 * | 9/2015 | Roberts | B65D 19/0002 |
| D753,476 | S * | 4/2016 | Roberts | D8/382 |
| 9,726,208 | B1 * | 8/2017 | Roberts | A47C 23/005 |
| 2013/0025051 | A1 * | 1/2013 | Syrowitz | A47C 19/021 5/400 |

* cited by examiner

*Primary Examiner* — David R Hare
*Assistant Examiner* — Adam C Ortiz

(57) ABSTRACT

A hybrid bed foundation assembly for quick and easy set up. The hybrid bed foundation assembly includes a frame assembly including elongated side members, elongated end members, elongated cross members and elongated brace members; a bracket assembly interconnecting the side members to the end members, the cross members to the side members and the brace members to the end members.

9 Claims, 3 Drawing Sheets

HYBRID BED FOUNDATION ASSEMBLY

CROSS-REFERENCE TO RELATED APPLICATIONS

The present invention claims the benefit of U.S. non-provisional application Appl. No. 62/492,078 filed Apr. 28, 2017, the disclosure of which is expressly incorporated by reference herein in its entirety.

BACKGROUND OF THE INVENTION

Field of the Invention

The present invention relates to bed foundations and more particularly to a new hybrid bed foundation assembly for quick and easy set up.

Description of the Prior Art

The use of bed foundations is known in the prior art. More specifically, bed foundations heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a pair of side rails; a pair of end rails, a top panel attachable to the rails, and a reinforcing mechanism. Another prior art includes an assembly of wooden components which interconnect to form an enclosed rectangular configuration for supporting a mattress. Also another prior art includes a first section hingedly secured to a second section so that the bedding foundation may be folded for storage or transportation purposes. Each section has a base, a plurality of wire struts pivotally secured to the base, an upper wire grid pirvotally secured to the wire struts and braces extending between the base and an outermost wire strut. While these devices fulfill their respective, particular objectives and requirements, the aforementioned patents do not disclose a new hybrid bed foundation assembly.

SUMMARY OF THE INVENTION

The general purpose of the present invention, which will be described subsequently in greater detail, is to provide a new hybrid bed foundation assembly which has many of the advantages of the bed foundations mentioned heretofore and many novel features that result in a new hybrid bed foundation assembly which is not anticipated, rendered obvious, suggested, or even implied by any of the prior art bed foundations, either alone or in any combination thereof. The present invention includes a frame assembly including elongated side members, elongated end members, elongated cross members and elongated brace members; a bracket assembly interconnecting the side members to the end members, the cross members to the side members and the brace members to the end members. None of the prior art includes the combination of the elements of the present invention.

There has thus been outlined, rather broadly, the more important features of the hybrid bed foundation assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new hybrid bed foundation assembly which has many of the advantages of the bed foundations mentioned heretofor and may novel features that result in a new hybrid bed foundation assembly which is not anticipated, rendered obvious, suggested, or even implied by any of the prior art bed foundations, either alone or in any combination thereof.

Still another object of the present invention is to provide a new hybrid bed foundation assembly for quick and easy set up.

Still yet another object of the present invention is to provide a new hybrid bed foundation assembly that is lightweight and can be assembled quickly for all different sizes of beds.

Even still another object of the present invention is to provide a new hybrid bed foundation assembly that is ready to assembly and is noise resistant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
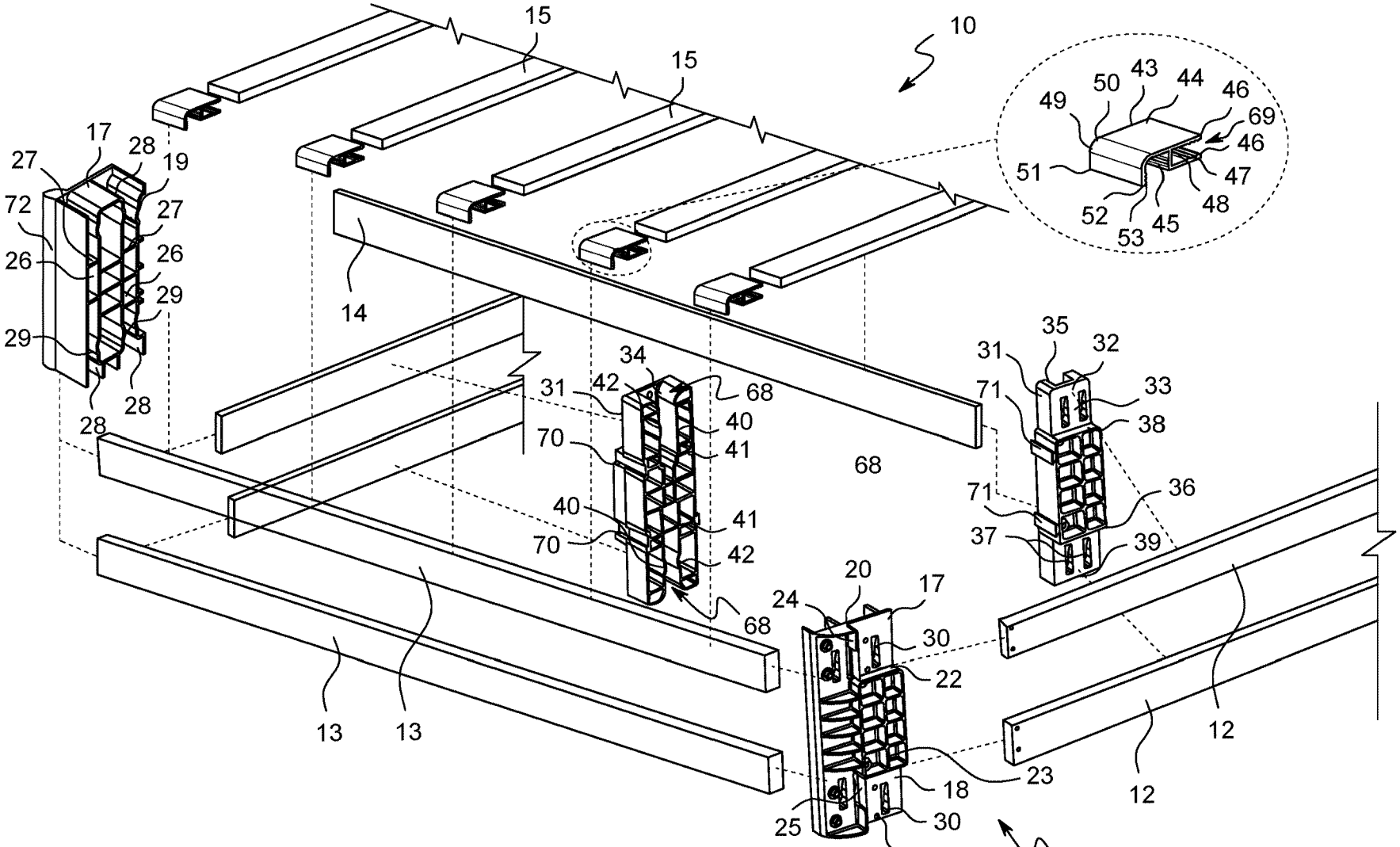
FIG. 1 is a partial exploded perspective view of a new hybrid bed foundation assembly according to the present invention.

With reference now to the drawings, and iii particular to FIGS. 1 through 3 thereof, a new hybrid bed foundation assembly embodying the principles and concepts of the present invention and generally designated by the reference numeral 10 will be described.

Figure 2:
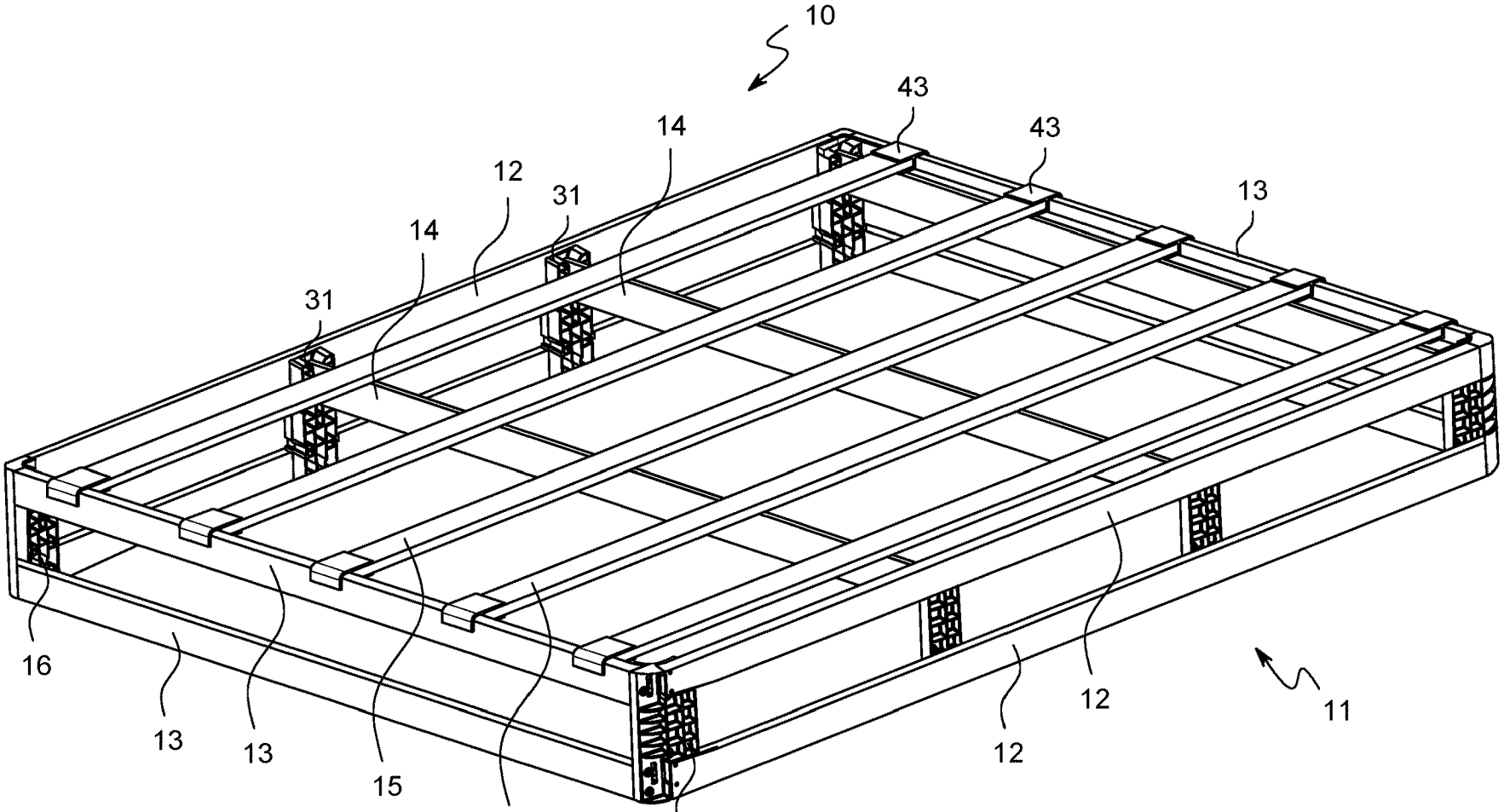
FIG. 2 is a top perspective view of the present invention.
Figure 3:
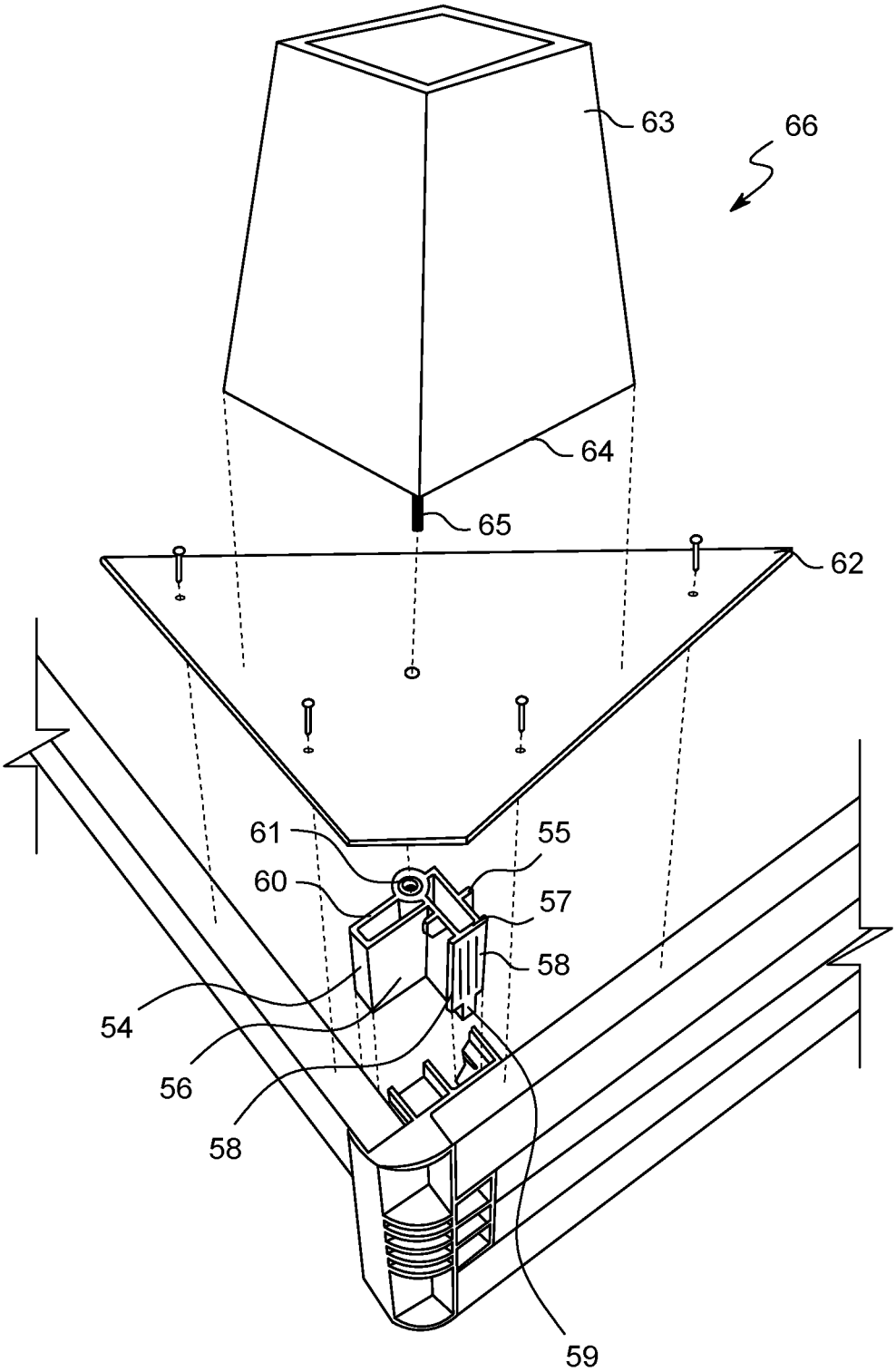
FIG. 3 is a perspective view of the leg assembly of the present invention.

As best illustrated in FIGS. 1 through 3, the hybrid bed foundation assembly 10 generally comprises a frame assembly 11 including elongated side members 12, elongated end members 13, elongated cross members 14 and elongated brace members 15; and also comprises a bracket assembly 67 interconnecting the side members 12 to the end members 13, the cross members 14 to the side members 12 and the brace members 15 to the end members 13.

The bracket assembly 67 includes corner brackets 16 each having a wall 17 with an outer side 18 and an inner side 19 and also having top and bottom ends 20, 21. Each of the corner brackets 16 has a ledge 22 integrally disposed upon the outer side 18 and spaced from and disposed parallel to the top end 20 upon which a respective side member 12 rests and is conventionally coupled to the respective corner bracket 16. Each of the corner brackets 16 further has a spacer 23 integrally disposed upon the outer side 18 and spaced from the ledge 22 and further spaced from and disposed parallel to the bottom end 21 and against which a respective side member 12 abuts and is conventionally coupled to the respective corner bracket 16. Each of the corner brackets also has an upper stopper 24 integrally disposed upon the outer side 18 and adjacent to the ledge 22 between the ledge 22 and the top end 20 and against which a respective side member 12 abuts, and further has a lower stopper 25 integrally disposed upon the outer side 18 and adjacent to the spacer 23 between the spacer 23 and the bottom end 21 and against which a respective end member 13 abuts. Also, each of the corner brackets 16 has a radius corner 72 integrally disposed upon the outer side 18 and extending the length of the corner bracket 16 for supporting a fabric cover (not shown).

Also, the corner brackets 16 have openings 30 and the side brackets 31 have openings 37, as shown in FIG. 1.

Each of the corner brackets 16 also has dividers 26 spaced apart and integrally disposed upon the inner side 19 and extending from near the top end 20 and terminating near the bottom end 21, and further has cross pieces integrally interconnecting the dividers 26 and forming slots 28 therebetween. The side members 12 are removably received and supported in the selected slots 28. Each of the corner brackets 16 has detents 29 being integral to the dividers 26 and extending into the slots 28 to retain and support a selective end member 13.

The bracket assembly 67 also includes side brackets 31 each having a wall 32 with an outer side 33 and an inner side 34 and also having top and bottom ends 35,39. Each of the brackets 31 has a ledge 38 integrally disposed upon the outer side 33 and spaced from and disposed parallel to the top end 35 upon which a respective side member 12 rests and is conventionally coupled to the respective side bracket 31. Each of the side brackets 31 further has a spacer 36 integrally disposed upon the outer side and spaced from the ledge 38 and further spaced from and disposed parallel to the bottom end 39 and against which a respective side member 12 abuts and is conventionally coupled to the respective side bracket 31. Each of the side brackets 31 also has dividers 40 spaced apart and integrally disposed upon the inner side 34 extending from near the top end 35 and terminating near the bottom end 39, and further has cross pieces conventionally interconnecting the dividers 40 and forming slots 68 therebetween. The cross members 14 are removably received and supported in the selected slots 68: Each of the side brackets 33 has detents 42 being integral to the dividers 40 and extending into the slots 68 to retain and support a selective cross member 14. Also, each of the side brackets 31 has dovetail connectors 70,71 conventionally disposed on side edges thereof for interlocking with other side brackets to facilitate packaging and transportation of the bed foundation assembly 10.

The bracket assembly 67 also has end brackets 43 each having a first portion 44 and a second portion 49. The end brackets 43 interconnect the brace members 15 to the end members 13. The first portion 44 of each end bracket 43 has an end portion 45 and wing portions 46 integrally extending outwardly from the end portion 45 and being spaced apart and extending parallel to one another and forming a slot 69 therebetween. Each of the wing portions 46 has a side 47 facing the other wing portion 46. At least one of the wing portions 46 has ribs 48 integrally disposed laterally upon the side 47. A respective brace member 15 is removably received and supported in the slot 69 between the wing portions 46. The second portion 49 of each of the end brackets 43 has a proximate portion 50 integral to the end portion 45 of the first portion 44 and extends outwardly therefrom and also has a distal portion 51 which is curved relative to the proximate portion 50. The distal portion 51 of the second portion 49 of each of the end brackets 43 has an inner side 52 facing the end portion 45 with ribs 53 integrally disposed laterally upon the inner side 52. The distal portion 51 is removably and engageably disposed about a respective end member 13 with the ribs 53 on the distal portion 51 gripping the respective and portion 45.

The hybrid bed foundation assembly 10 further comprises a leg assembly 66 in communication with the frame assembly 11 and the bracket assembly 67 and including a leg support bracket 54, a leg support member 62 and a leg member 63. The leg support bracket 54 has a first end portion 55 and a second end portion 56 angled relative to the first end portion 55 and has a top end 60 with a bore 61 disposed in the top end 60 at a junction of the first and second end portions 55,56. The first end portion 55 has a distal end 57 with flanges 58 integrally disposed along longitudinal edges of the distal end 57 and a tab 59 integrally extending from a bottom end of the distal end 57 for retaining the leg support bracket 54 in a selected slot 28 of a respective corner bracket 16. The leg support member 62 is conventionally fastened upon the leg support bracket 54 and to respective end and side members 12,13, and the leg member 63 has a fastener 65 conventionally extending from an end 64 thereof and threaded through the leg support member 63 and into the bore 61 of the leg support bracket 54.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one of ordinary skill in the art, and all equivalent relationships to those illustrated in the drawings and described in the specification are intended to be encompassed by the present invention.

Therefore, the foregoing is considered as illustrative only of the principles of the hybrid bed foundation assembly. Further since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hybrid bed foundation assembly, comprising:

a frame assembly including enlongated side members, elongated end members, elongated cross members and elongated brace members;

a bracket assembly interconnecting the side members to the end members, the cross members to the side members and the brace members to the end members, wherein the bracket assembly also includes side brackets each having a wall with an outer side and an inner side and also having top and bottom ends, wherein each of the side brackets also has dividers spaced apart and disposed upon the inner side extending from near the top end and terminating near the bottom end, and further has cross pieces interconnecting the dividers and forming slots therebetween, wherein the cross members are removably received and supported in selected said slots, and wherein each of the side brackets has detents being integral to the dividers and extending into the slots to retain and support a selective said cross member, each of the side brackets also has dovetail connectors disposed on side edges of a respective said side bracket for interlocking with other side brackets to facilitate packaging and transportation of the bed foundation.

2. The hybrid bed foundation assembly as described in claim 1, wherein the bracket assembly also has end brackets each having a first portion and a second portion, wherein the end brackets interconnect the brace members to the end members.

3. The hybrid bed foundation assembly as described in claim 2, wherein the first portion of each said end bracket has an end portion and wing portions extending outwardly from the end portion and being spaced apart and extending parallel to one another and forming a slot therebetween.

4. The hybrid bed foundation assembly as described in claim 3, wherein each of the wing portions has a side facing the other said wing portion, wherein at least one of the wing portions has ribs disposed laterally upon the side, wherein a respective said brace member is removably received and supported in the slot between the wing portions.

5. The hybrid bed foundation assembly as described in claim 3, wherein the second portion of each of the end brackets has a proximate portion integral to the end portion of the first portion and extends outwardly therefrom and also has a distal portion which is integral to and curved relative the proximate portion.

6. The hybrid bed foundation assembly as described in claim 1 further comprises a leg assembly in communication with the frame assembly and the bracket assembly and including a leg support bracket, a leg support member and a leg member.

7. The hybrid bed foundation assembly as described in claim 6, wherein the leg support bracket has a first end portion and a second end portion angled relative to the first end portion and has a top end with a bore disposed in the top end at a junction of the first and second end portions, wherein the first end portion has a distal end with flanges disposed along longitudinal edges of the distal end and a tab extending from a bottom end of the distal end for retaining the leg support bracket in a selected said slot of a respective said corner bracket.

8. The hybrid bed foundation assembly as described in claim 7, wherein the leg support member is fastened upon the leg support bracket and to respective said end and side members, and the leg member has a fastener extending from an end thereof and threaded through the leg support member and into the bore of the leg support bracket.

9. A hybrid bed foundation assembly, comprising:

a frame assembly including enlongated side members, elongated end members, elongated cross members and elongated brace members;

a bracket assembly interconnecting the side members to the end members, the cross members to the side members and the brace members to the end members;

wherein the bracket assembly also has end brackets each having a first portion and a second portion, wherein the end brackets interconnect the brace members to the end members, wherein the first portion of each said end bracket has an end portion and wing portions extending outwardly from the end portion and being spaced apart and extending parallel to one another and forming a slot therebetween, wherein the second portion of each of the end brackets has a proximate portion integral to the end portion of the first portion and extends outwardly therefrom and also has a distal portion which is integral to and curved relative the proximate portion, and wherein the distal portion of the second portion of each of the end brackets has an inner side facing the end portion with ribs disposed laterally upon the inner side, wherein the distal portion is removably engaged about a respective said end member with the ribs on the distal portion gripping the respective said end portion.

* * * * *